US012209476B2

(12) United States Patent
Vasques

(10) Patent No.: US 12,209,476 B2
(45) Date of Patent: Jan. 28, 2025

(54) DOWNHOLE SEALING ASSEMBLY

(71) Applicant: Welltec Manufacturing Center Completions ApS, Esbjerg (DK)

(72) Inventor: Ricardo Reves Vasques, Zug (CH)

(73) Assignee: Welltec Manufacturing Center Completions ApS, Esbjerg (DK)

( * ) Notice: Subject to any disclaimer, the term of this patent is extended or adjusted under 35 U.S.C. 154(b) by 0 days.

(21) Appl. No.: 18/315,764

(22) Filed: May 11, 2023

(65) Prior Publication Data

US 2023/0366287 A1 Nov. 16, 2023

(30) Foreign Application Priority Data

May 12, 2022 (EP) ..... 22173008

(51) Int. Cl.
*E21B 33/10* (2006.01)
*E21B 33/12* (2006.01)

(52) U.S. Cl.
CPC ..... *E21B 33/10* (2013.01); *E21B 33/1208* (2013.01)

(58) Field of Classification Search
CPC .. E21B 33/1208; E21B 33/10; E21B 33/1212; E21B 2200/01
See application file for complete search history.

(56) References Cited

U.S. PATENT DOCUMENTS 4,381,114 A * 4/1983 Vanderford, Jr. ..... E21B 33/04 285/96
4,900,041 A * 2/1990 Hopkins ..... E21B 33/04 166/115
4,923,006 A * 5/1990 Hartmann ..... E21B 17/003 166/208
5,224,715 A * 7/1993 Downes ..... E21B 33/04 277/626
5,997,003 A * 12/1999 Turner ..... E21B 33/04 277/335
6,164,663 A 12/2000 Turner
8,622,142 B2 * 1/2014 Shaw ..... E21B 33/04 166/368

(Continued)

FOREIGN PATENT DOCUMENTS

GB 2217795 A * 11/1989 ..... E21B 33/04

OTHER PUBLICATIONS

Extended European Search Report for EP22173008.8 mailed Oct. 18, 2022, 5 pages.

*Primary Examiner* — Daniel P Stephenson
(74) *Attorney, Agent, or Firm* — Nixon & Vanderhye P.C.

(57) ABSTRACT

A downhole sealing assembly for providing a seal in a borehole between first and second faces of a completion component includes an annular sealing element for arrangement on the second face and having a base part, first and second annular flanges extending from the base part, forming a cavity between the first and second annular flanges, the first annular flange being arranged closest to the first face and having a projection for abutment to the second face; and a metal ring-shaped element arranged in the cavity, the metal ring-shaped element having a first ring face forming a first indentation for receiving the first annular flange. The downhole sealing assembly further comprises a first spring element arranged in the cavity between the first annular flange and the metal ring-shaped element in order to press the first annular flange to abut against the second face.

15 Claims, 7 Drawing Sheets

(56) References Cited

U.S. PATENT DOCUMENTS

Figure 1:
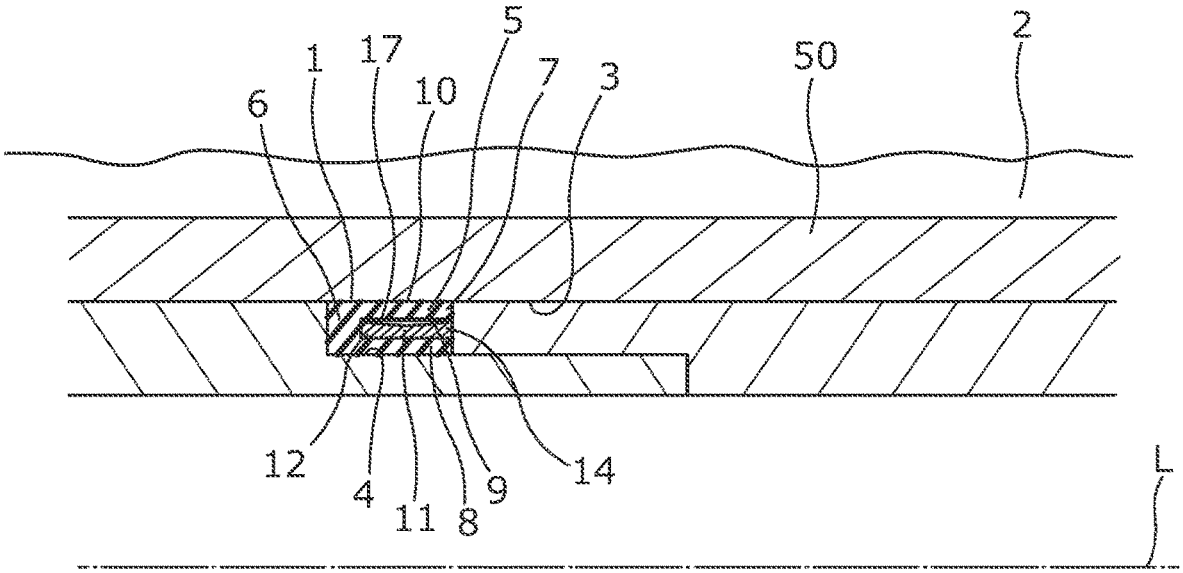

| | | | | |
|---|---|---|---|---|
| 9,140,388 | B2 * | 9/2015 | Baca | F16L 7/02 |
| 9,506,588 | B2 * | 11/2016 | Cronin | F16J 15/166 |
| 11,994,244 | B2 * | 5/2024 | Mann | F16L 23/20 |
| 2008/0029264 | A1 | 2/2008 | Williams et al. | |
| 2014/0069646 | A1 | 3/2014 | Barnhart et al. | |
| 2022/0003067 | A1 | 1/2022 | Glaesman | |
| 2023/0366287 | A1 * | 11/2023 | Vasques | E21B 33/10 |

* cited by examiner

DOWNHOLE SEALING ASSEMBLY

This application claims priority to EP patent application Ser. No. 22/173,008.8 filed May 12, 2022, the contents of which is hereby incorporated by reference.

The present invention relates to a downhole sealing assembly for providing a seal in a borehole between a first face and a second face of a completion component having an axial extension along the borehole. The invention also relates to a downhole sealing unit comprising a first downhole sealing assembly and a second downhole sealing assembly. Moreover, the invention relates to a completion component comprising a first component part having a first face and a second component part having a second face. Finally, the invention also relates to a downhole system comprising the completion component mounted as part of a well tubular metal structure and an annular barrier.

Completion devices in an oil or gas well often need sealing means in order to control the flow of fluids in the well. One completion device is a sliding sleeve that can be operated to provide a flow path between the production conduit and the annulus. Sliding sleeves incorporate a system of ports that can be opened or closed by a sliding component that is generally controlled and operated by an intervention tool string. Known conventional sealing means are rated to a certain pressure difference and a certain temperature. However, some wells experience larger differential pressure and higher temperatures for the known sealing means to function in these wells.

It is an object of the present invention to wholly or partly overcome the above disadvantages and drawbacks of the prior art. More specifically, it is an object to provide an improved sealing assembly being able to seal between two faces downhole also at temperatures above 220° C. and to withstand a pressure difference above 1400 PSI.

The above objects, together with numerous other objects, advantages and features, which will become evident from the below description, are accomplished by a solution in accordance with the present invention by a downhole sealing assembly for providing a seal in a borehole between a first face and a second face of a completion component having an axial extension along the borehole, comprising:

an annular sealing element for arrangement on the second face and having a base part and a first annular flange and a second annular flange extending from the base part along the axial extension, forming a cavity between the first and second annular flanges, the first annular flange being arranged closest to the first face and having a projection for abutment to the second face, and a metal ring-shaped element arranged in the cavity and having a first ring end close to the base part and a second ring end opposite the first ring end, the metal ring-shaped element having a first ring face forming a first indentation for receiving the first annular flange, wherein the downhole sealing assembly further comprises a first spring element arranged in the cavity between the first annular flange and the metal ring-shaped element in order to press the first annular flange to abut against the second face.

Also, the first indentation may be a curvature from the first ring end to the second ring end so that the first ring face is concave, forming the curvature.

Moreover, the first spring element may be plate- and tubular-shaped.

In addition, the cavity may have an extension extending from the base part to an end of the first annular flange, the spring element having the same extension as the cavity.

Moreover, the first indentation may have a first indentation length along the axial extension.

Further, the projection of the first annular flange may have a first projection length which is shorter than the first indentation length.

Also, the first spring element may have a first element length along the axial extension.

Furthermore, the metal ring-shaped element may have a second length along the axial extension, and the first element length may be substantially the same length as the second length.

In addition, the first spring element may be ring-shaped.

Moreover, the first spring element may have a slit.

Further, the metal ring-shaped element may have a slit so that the metal ring-shaped element can be slightly expanded when the metal ring-shaped element is mounted.

Also, the second annular flange may comprise a projection projecting away from the first annular flange.

Furthermore, the first annular flange in cross-section may have a U-shape forming a lip flange for abutting the second face.

In addition, the projection of the first annular flange may be part of the lip flange.

Moreover, the metal ring-shaped element may be formed of two abutting ring-shaped elements being a first metal ring-shaped element and a second metal ring-shaped element.

Further, the first ring face forming a first indentation may be formed partly of the first metal ring-shaped element and partly of the second metal ring-shaped element for forming the cavity.

Also, the lip flange may have a tip facing towards the base part.

Moreover, the downhole sealing assembly may further comprise a second spring element arranged between the lip flange and the first annular flange.

Further, the second spring element may overlap the base part.

Also, the second spring element may be ring-shaped.

Furthermore, the second spring element may have a slit.

In addition, the metal ring-shaped element may have a second ring face forming a second indentation for receiving the second annular flange.

Moreover, the second ring face may be concave towards the second annular flange for receiving the second annular flange so that the second ring face forms the second indentation, in the form of a curvature, from the first ring end to the second ring end.

Further, the second indentation may have a second indentation length along the axial extension.

Also, the projection of the second annular flange may have a second projection length which is shorter than the second indentation length.

Furthermore, the downhole sealing assembly may also comprise a third spring element between the second ring face and the second annular flange.

In addition, the second annular flange may be shorter than the first annular flange along the axial extension.

Moreover, the second ring face may face the second annular flange.

Further, the second ring face may be straight.

Also, the first ring face may face the first annular flange.

Furthermore, one of the first ring face and the second ring face may be substantially straight, and the other of the first ring face and the second ring face may have an indentation such as a curvature.

In addition, the downhole sealing assembly may further comprise a fourth spring element abutting the second spring element so as to strengthen the second spring element.

Moreover, the downhole sealing assembly may further comprise a metal ring having a flange overlapping the base part of the downhole sealing assembly and a body part abutting the base part, forming a back-up to the annular sealing element.

Further, the flange may have a flange length along the axial extension being the same or longer than the first thickness of the base part.

Also, the annular sealing element may be made of Polytetrafluoroethylene (PTFE).

Furthermore, the spring elements may be made of spring metal or spring steel.

In addition, the metal ring-shaped element may be made of metal proven for use in an oil or gas well.

The invention moreover relates to a downhole sealing unit comprising a first downhole sealing assembly and a second downhole sealing assembly, wherein the base part of the first downhole sealing assembly is arranged closer to the base part of the second downhole sealing assembly than the first annular flanges are to each other so that the first annular flange of the first downhole sealing assembly extends from the base part of the first downhole sealing assembly away from the first annular flange of the second downhole sealing assembly.

Further, the first downhole sealing assembly and the second downhole sealing assembly may be arranged back-to-back in that the base parts are closer to each other than the first annular flanges are to each other.

Also, the downhole sealing unit may further comprise a metal ring having a T-shape in cross-section, the metal ring being arranged between the first downhole sealing assembly and the second downhole sealing assembly, abutting the base parts of the first and second downhole sealing assemblies.

Furthermore, the metal ring may comprise two flanges, each flange overlapping the base part of the first downhole sealing assembly and the second downhole sealing assembly, respectively, and a body part being arranged between the first downhole sealing assembly and the second downhole sealing assembly.

In addition, the metal ring having a T-shape in cross-section may be formed of a stem part and projecting flanges.

Moreover, the downhole sealing unit may further comprise a first element having a first inclined face abutting a second inclined face of the metal ring.

Further, the downhole sealing unit may further comprise a first element having a first inclined face abutting a second inclined face on a first side of the metal ring and a second element having a first inclined face abutting a second inclined face on a second side of the metal ring.

Also, the metal ring may be formed of two abutting rings being a first metal ring and a second metal ring.

Furthermore, each abutting ring may have an L-shaped cross-section.

Further, the downhole sealing unit may further comprise a first element having a first inclined face abutting a second inclined face on the first metal ring and a second element having a first inclined face abutting a second inclined face on the second metal ring.

In another embodiment, the downhole sealing unit may comprise a first downhole sealing assembly and a second downhole sealing assembly, wherein the first downhole sealing assembly abuts the second downhole sealing assembly so that the first annular flange of the first downhole sealing assembly extends towards and faces the first annular flange of the second downhole sealing assembly.

In addition, the downhole sealing unit may comprise a first metal ring and a second metal ring.

Moreover, the first metal ring may be arranged to abut the base part of the first downhole sealing assembly, and the second metal ring may be arranged to abut the base part of the second downhole sealing assembly.

Further, the first metal ring having an L-shaped cross-section may be formed of a stem part and one projecting flange.

Also, the second metal ring having an L-shaped cross-section may be formed of a stem part and one projecting flange.

Furthermore, the metal ring-shaped element of the first downhole sealing assembly may abut the metal ring-shaped element of the first downhole sealing assembly.

In addition, the at least one through-bore may intersect both metal ring-shaped elements, so that part of the through-bore forms a groove in one of the metal ring-shaped elements, and the other part of the through-bore forms a groove in the other of the metal ring-shaped elements, which grooves together form the through-bore.

Moreover, the downhole sealing unit may further comprise a first element having a first inclined face abutting a second inclined face of the first metal ring and a second element having a first inclined face abutting a second inclined face of the second metal ring.

In addition, the metal ring may have at least one through-bore extending radially in a direction perpendicular to the axial extension for providing fluid communication.

Also, the at least one through-bore may intersect both of the two abutting rings, so that part of the through-bore forms a groove in one of the two abutting rings, and the other part of the through-bore forms a groove in the other of the two abutting rings, which grooves together form the through-bore.

Moreover, the metal ring may have a first projecting flange overlapping the base part of the first downhole sealing assembly along the axial extension and a second projecting flange overlapping the base part of the second downhole sealing assembly along the axial extension.

Further, the base part may have a first thickness along the axial extension, the first annular flange having a second thickness, and the second annular flange having a third thickness perpendicular to the axial extension, the first thickness being greater than the second thickness and/or the third thickness.

Also, the base part may have a first height, and the annular sealing element may have a first length along the axial extension which is longer than the first height.

Furthermore, the metal ring-shaped element may have a second length along the axial extension being shorter than the first length.

The invention also relates to a completion component comprising a first component part having a first face and a second component part having a second face facing the first face, the first component part and the second component part being slidable in relation to each other, and the completion component further comprising a downhole sealing assembly for arrangement between the first face and the second face.

Moreover, the completion component may be a sliding sleeve or a telescopic joint.

Further, the sliding sleeve may have a sliding sleeve part being the second component part, and the sliding sleeve part may be slidable in relation to an opening in a tubular section being the first component part and mountable as part of a well tubular metal structure.

Also, the tubular section may comprise a groove in which the slidable sleeve is slidably arranged.

Furthermore, the telescopic joint may be mountable as part of a well tubular metal structure, and the first component part may comprise a first part overlapping a second part of the second component part.

In addition, the telescopic joint may comprise a plurality of downhole sealing assemblies arranged in between the first component part and the second component part for sealing against the first face and the second face.

Moreover, the second component part may comprise an outer projection projecting radially outwards from the second face, the outer projection having an outer diameter larger than an inner diameter of the first component part so as to hinder the first component part from sliding past the outer projection.

Further, the first component part may comprise an inner projection projecting radially inwards from the first face so as to hinder the second component part from sliding past the inner projection.

The invention further relates to a downhole system comprising the completion component mounted as part of a well tubular metal structure and an annular barrier.

Finally, the annular barrier may comprise a tubular metal part having an aperture and an expandable metal sleeve surrounding the tubular metal part, each end of the expandable metal sleeve being connected with the tubular metal part, forming an expandable space when fluid enters the aperture for expanding the expandable metal sleeve until the expandable metal sleeve abuts a wall of the borehole.

Figure 2:
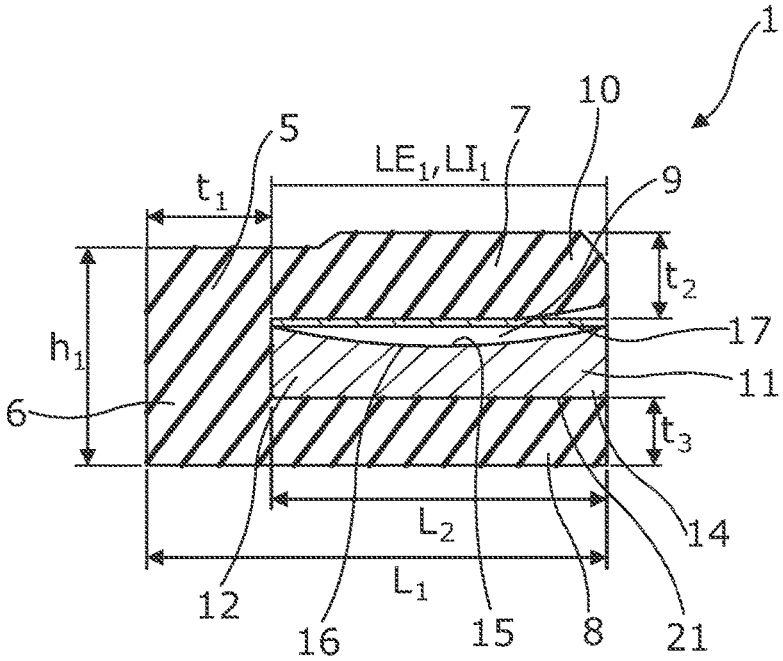
Figure 3:
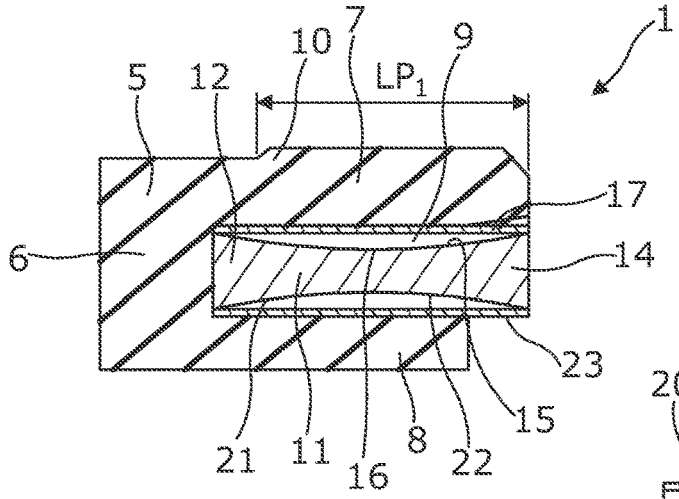
Figure 4:
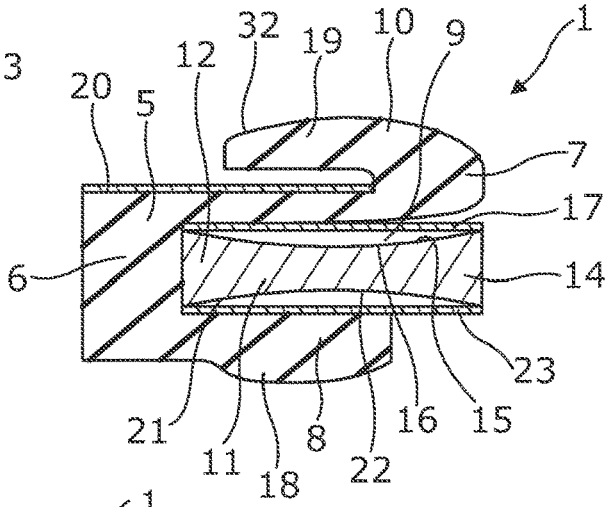
Figure 5:
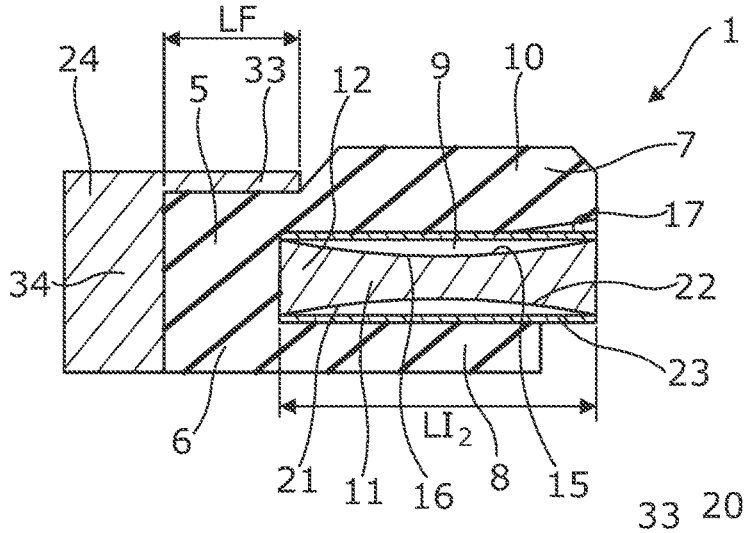
Figure 6:
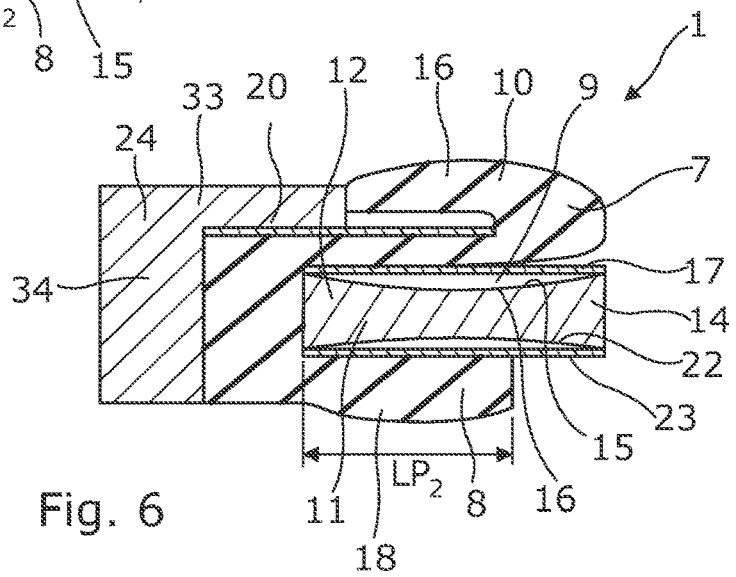
Figure 7:
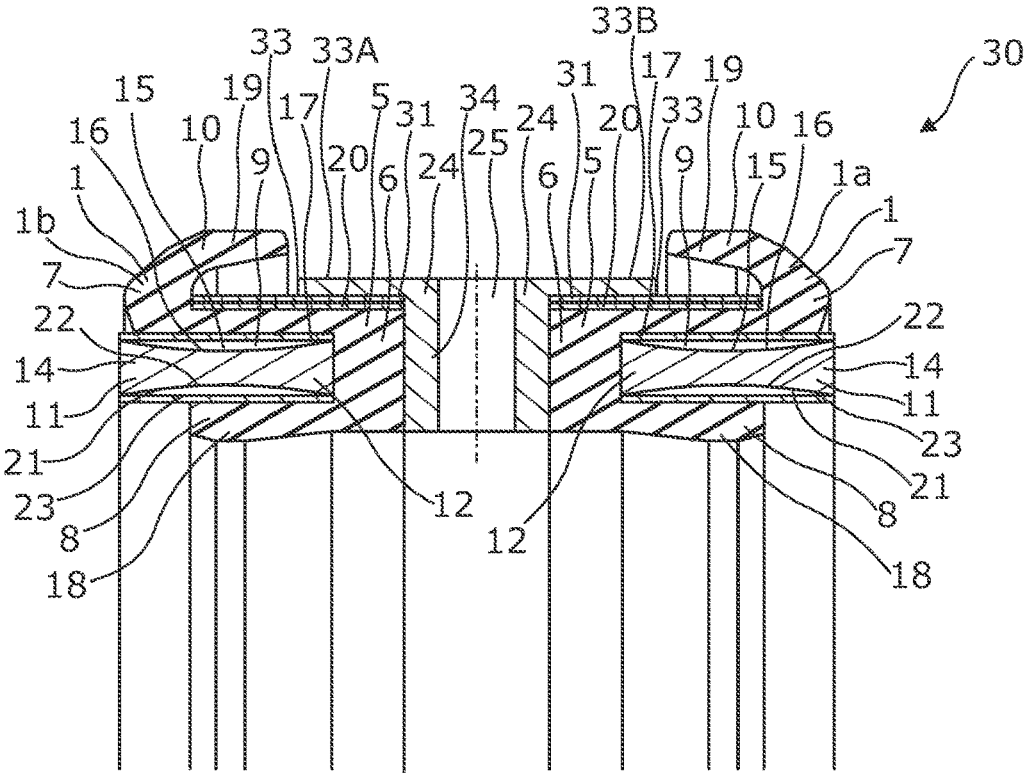
Figure 8:
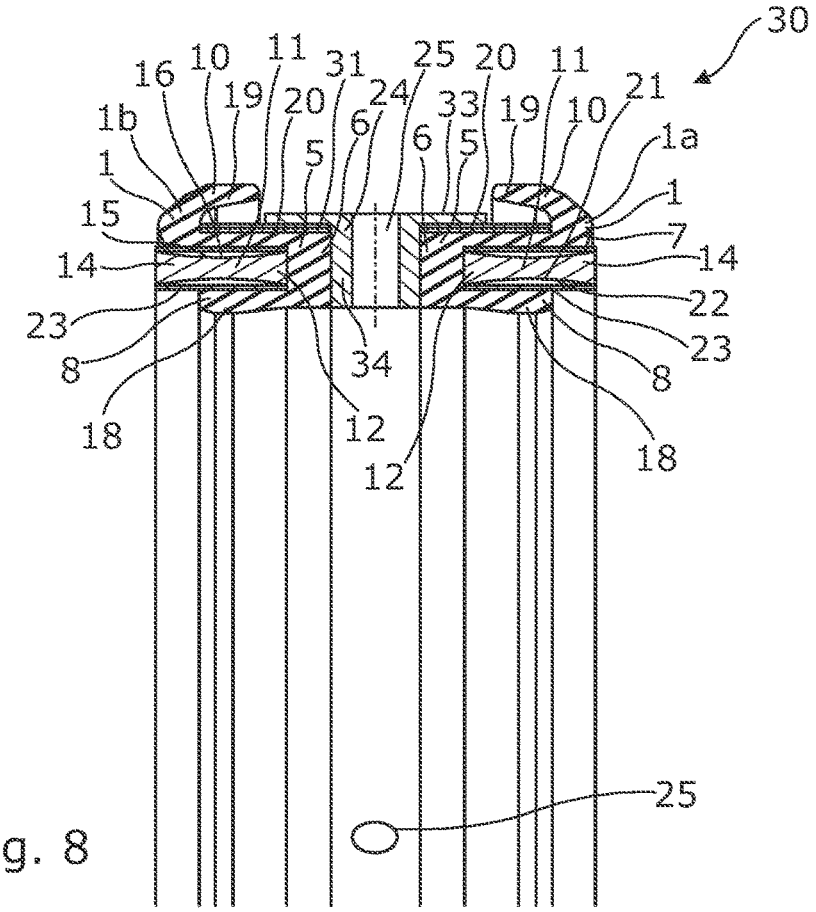
Figure 9:
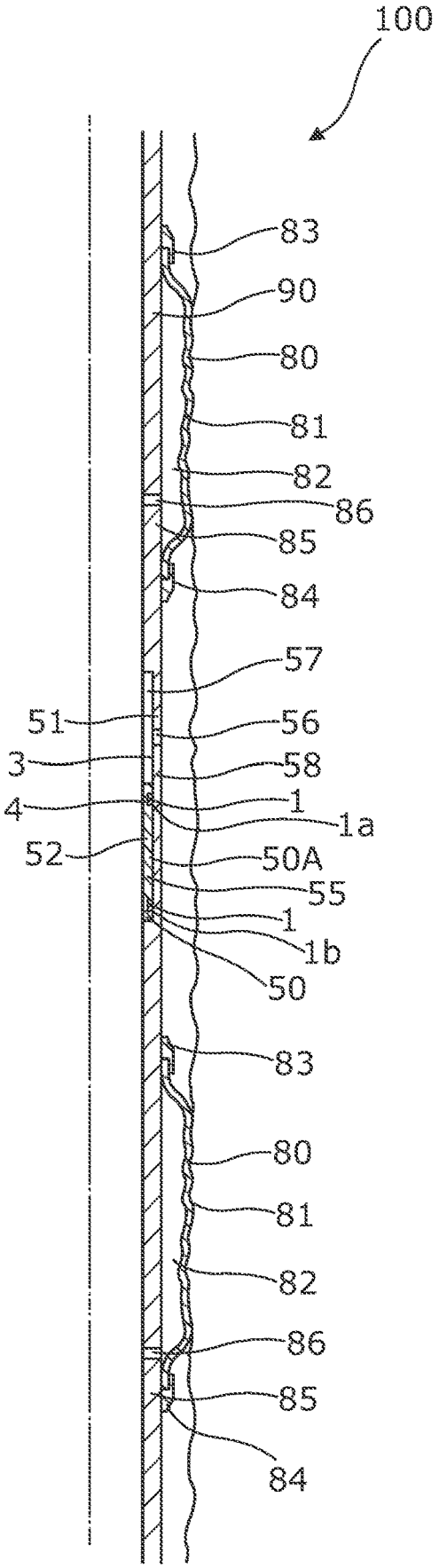
Figure 10A:
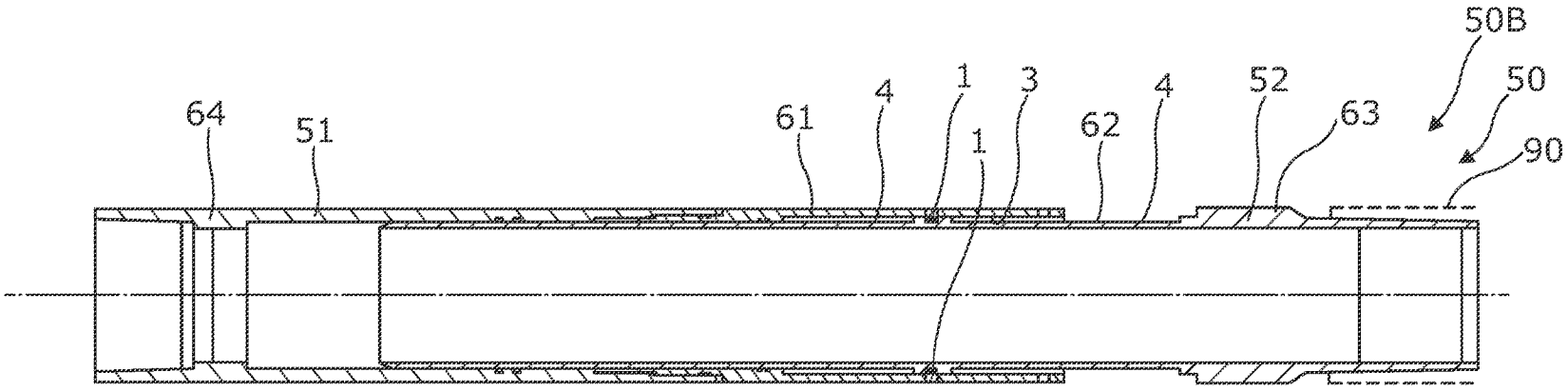
Figure 10B:
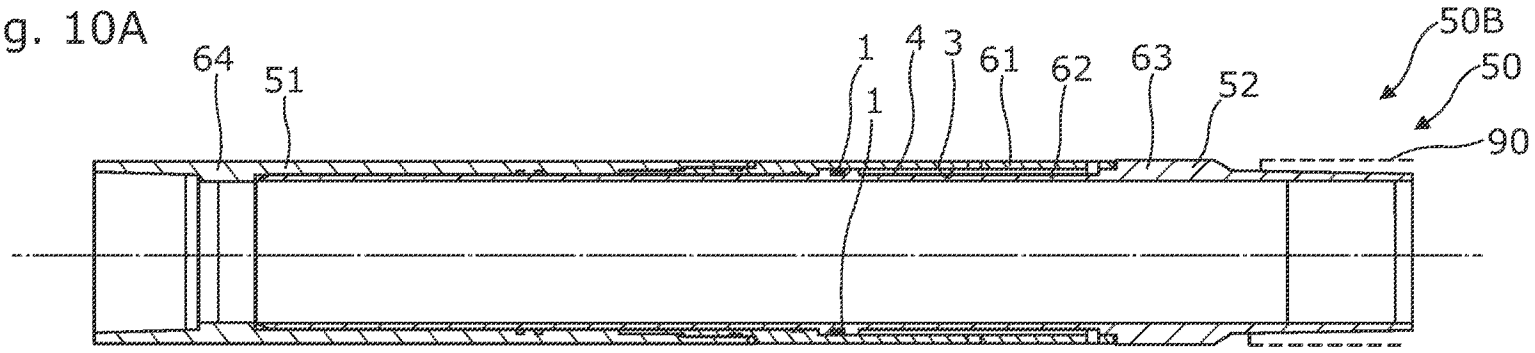
Figure 10C:
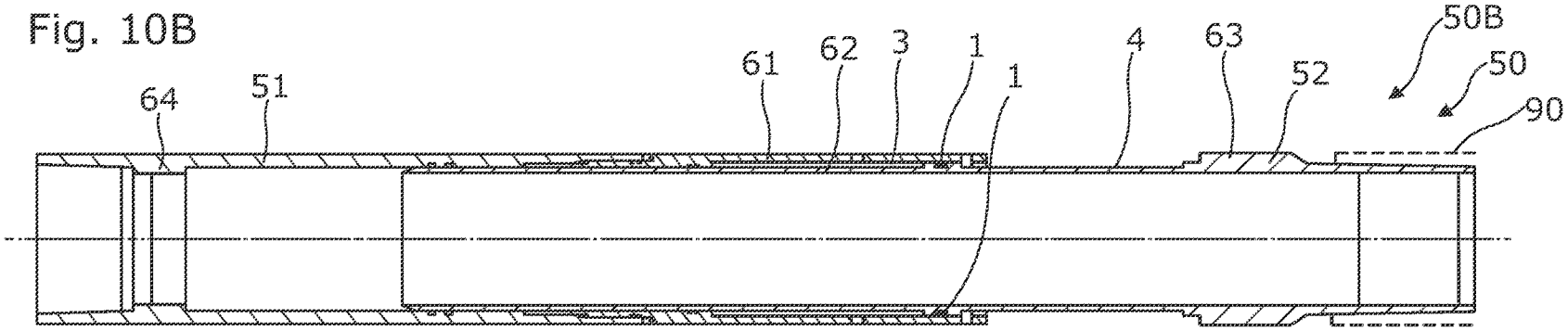
Figure 11:
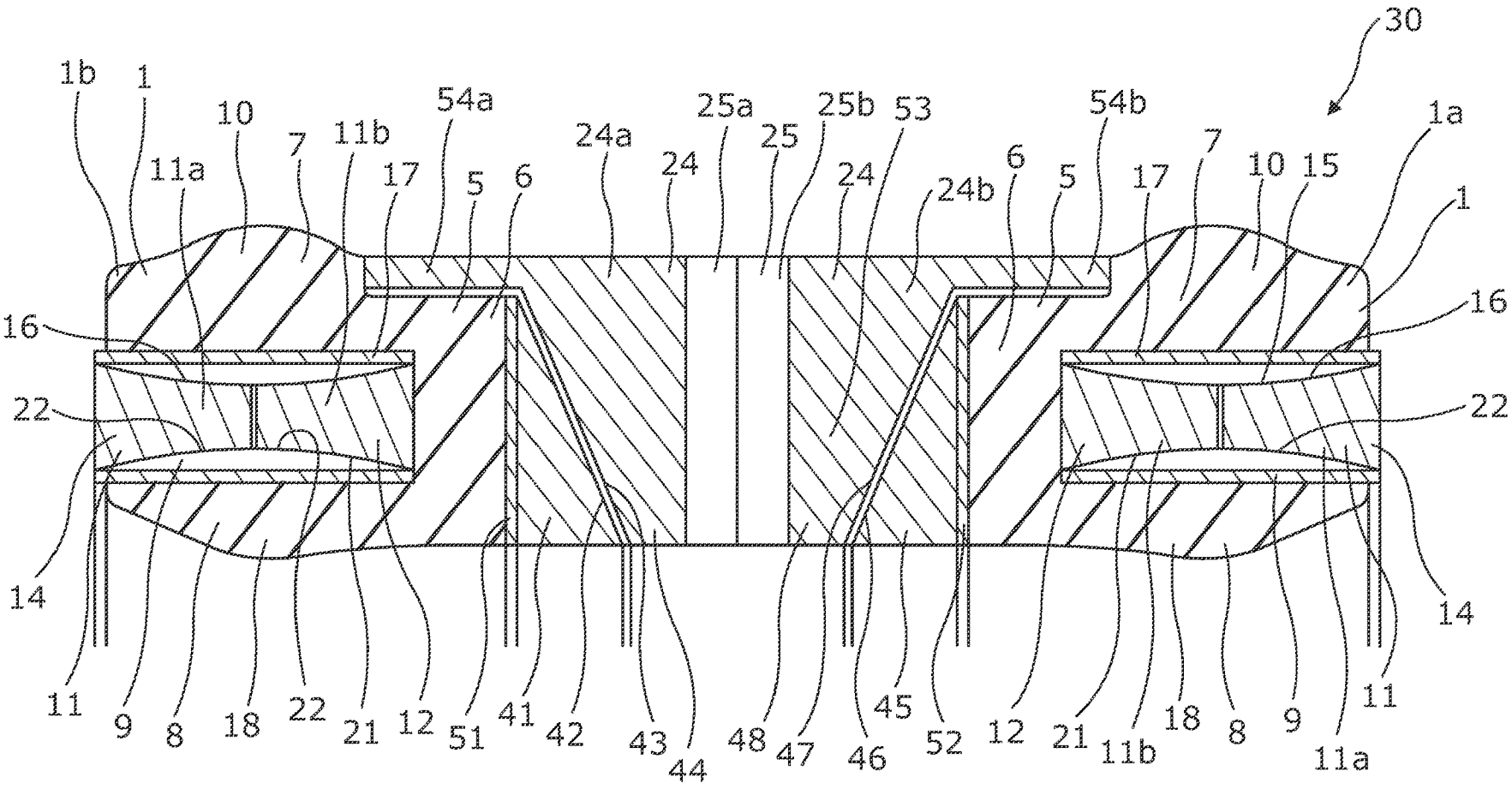
Figure 12:
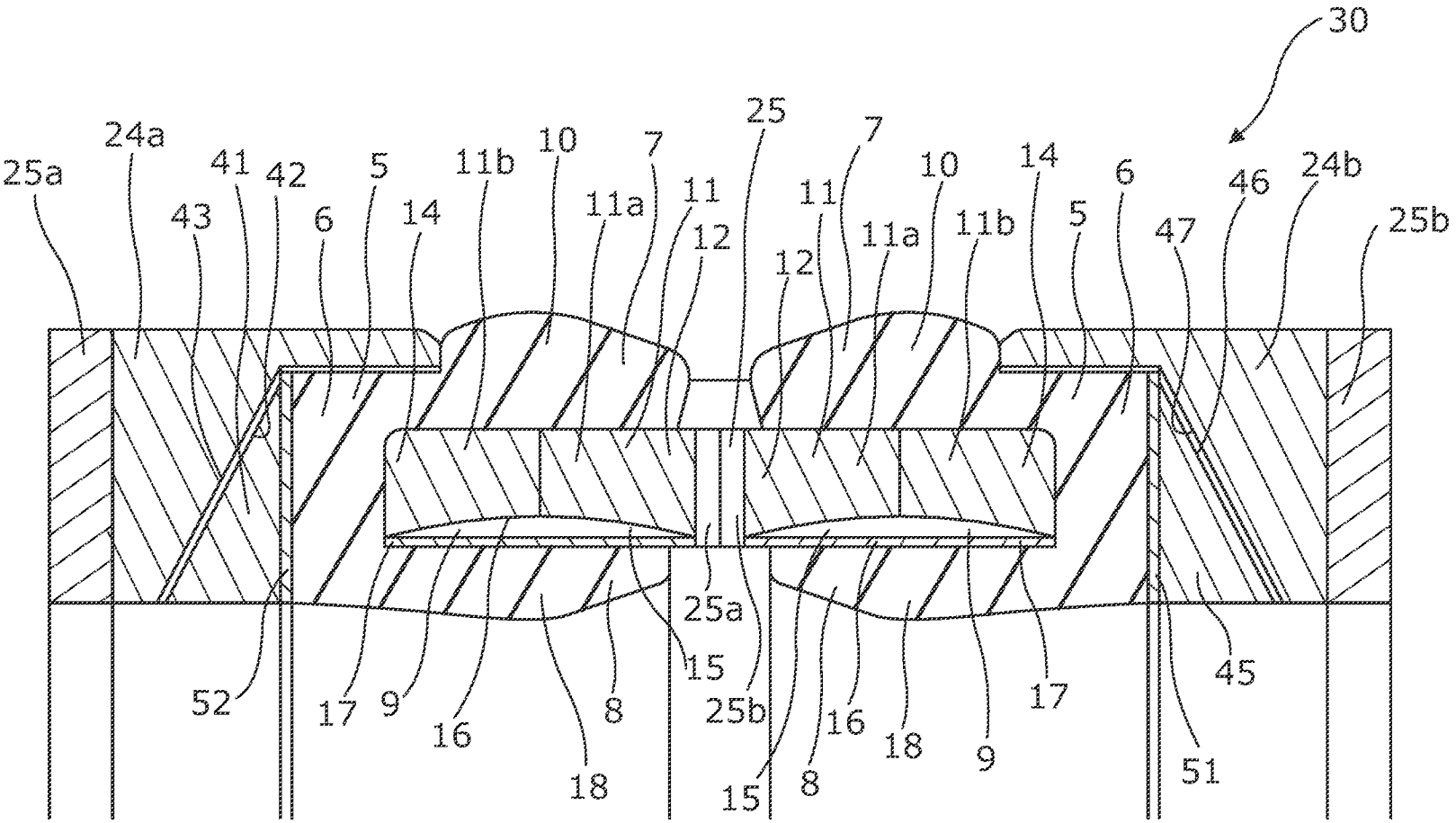

The invention and its many advantages will be described in more detail below with reference to the accompanying schematic drawings, which for the purpose of illustration show some non-limiting embodiments and in which:

FIG. 1 shows a cross-sectional view of a downhole sealing assembly for providing a seal in a borehole between a first face and a second face of a completion component, FIG. 2 shows a cross-sectional view of the downhole sealing assembly shown in FIG. 1, FIG. 3 shows a cross-sectional view of another downhole sealing assembly having both a first and a second indentation opposite a spring element, FIG. 4 shows a cross-sectional view of another downhole sealing assembly wherein the first annular flange in cross-section has a U-shape forming a lip flange, FIG. 5 shows a cross-sectional view of yet another downhole sealing assembly having a seal back-up, FIG. 6 shows a cross-sectional view of yet another downhole sealing assembly wherein the second annular flange comprises a projection, FIG. 7 shows a cross-sectional view of a downhole sealing unit comprising two downhole sealing assemblies facing in opposite directions so that the lip flanges point towards each other, FIG. 8 shows a cross-sectional view of another downhole sealing unit having several through-bores in the metal ring, FIG. 9 shows a cross-sectional view of a downhole system comprising a completion component being a sliding sleeve and annular barriers, FIG. 10A shows a cross-sectional view of a completion component being a telescopic joint in an initial position, FIG. 10B shows the completion component of FIG. 10A in a "stroked-in" position, FIG. 10C shows the completion component of FIG. 10A in a "stroked-out" position, FIG. 11 shows a cross-sectional view of yet another downhole sealing unit, and FIG. 12 shows a cross-sectional view of a further downhole sealing unit.

All the figures are highly schematic and not necessarily to scale, and they show only those parts which are necessary in order to elucidate the invention, other parts being omitted or merely suggested.

FIG. 1 shows a downhole sealing assembly 1 providing a seal in a borehole 2 between a first face 3 and a second face 4 of a completion component 50 having an axial extension L along the borehole 2. The downhole sealing assembly 1 comprises an annular sealing element 5 arranged on the second face 4 and having a base part 6, a first annular flange 7 and a second annular flange 8. Both the first annular flange 7 and the second annular flange 8 extend from the base part 6 in a first direction along the axial extension L, forming a cavity 9 between the first and second annular flanges 7, 8. The first annular flange 7 is arranged closest to the first face 3 and has a projection 10 abutting the second face 4. The annular sealing element 5 is formed as a coherent ring. The annular sealing element 5 may in another embodiment have a slit along the axial extension L so that it is easier to mount. The downhole sealing assembly 1 further comprises a metal ring-shaped element 11 arranged in the cavity 9 and having a first ring end 12 closest to the base part 6 and a second ring end 14 opposite the first ring end 12. As shown in FIG. 2, the metal ring-shaped element 11 has a first ring face 15 being concave towards the first annular flange 7 for receiving the first annular flange 7 when the downhole sealing assembly 1 is arranged between the first and second faces 3, 4. Thus, the first ring face 15 forms a first indentation 16, such as a curvature, from the first ring end 12 to the second ring end 14. The downhole sealing assembly 1 further comprises a first spring element 17 arranged in the cavity 9 between the first annular flange 7 and the metal ring-shaped element 11 in order to press the first annular flange 7 to abut against the second face 4. When the downhole sealing assembly 1 is arranged between the first and second faces 3, 4, the annular sealing element 5 is squeezed, and the first annular flange 7 is pressed into the first indentation 16, stretching the first spring element 17, whereupon the inherent spring force in the first spring element 17 will force the first annular flange 7 radially outwards towards the second face 4, thus providing an enhanced seal. Thus, the downhole sealing assembly 1 is in FIG. 1 shown in a slightly compressed and tensioned condition, and in FIG. 2 the downhole sealing assembly 1 is shown in a relaxed condition.

As shown in FIGS. 1 and 2, the first spring element 17 is plate- and tubular-shaped. Thus, the first spring element 17 is ring-shaped. The first spring element 17 may in one aspect have a slit (not shown) along the axial extension L so that the first spring element 17 can be slightly expanded when mounted in the cavity. The cavity 9 has an extension extending from the base part 6 to an end of the first annular flange 7, and the first spring element 17 has the same extension as the cavity 9. The first indentation 16 has a first indentation length $LI_1$ along the axial extension L, and the projection 10 of the first annular flange 7 has a first projection length $LP_1$ (shown in FIG. 3) which is shorter than the first indentation length W. The first spring element 17 has a first element length $LE_1$ along the axial extension L. The metal ring-shaped element 11 has a second length $L_2$ along the axial extension L, and the first element length $LE_1$ is substantially the same as the second length. The metal ring-shaped element 11 may in one aspect have a slit (not shown) along the axial extension L so that the metal ring-shaped element 11 can be slightly expanded when mounted. The base part 6 has a first thickness $t_1$ along the axial extension L. The first annular flange 7 has a second thickness $t_2$ perpendicular to the axial extension L, and the second annular flange 8 has a third thickness $t_3$ perpendicular to the axial extension L, the first thickness $t_1$ being greater than the second thickness $t_2$ and the third thickness $t_3$. The base part 6 has a first height hi perpendicular to the axial extension L in a radial direction, and the annular sealing element 5 has a first length $L_1$ along the axial extension L which is greater than the first height hi. The metal ring-shaped element 11 has a second length $L_2$ along the axial extension L that is shorter than the first length $L_1$. The first ring face 15 faces the first annular flange 7, and a second ring face 21 faces the second annular flange 8 and is straight. Thus, in FIG. 2 one of the first ring face 15 and the second ring face 21 is substantially straight, and the other of the first ring face 15 and the second ring face 21 has an indentation such as a curvature, i.e. the metal ring-shaped element 11 is concave at one side.

In FIG. 3, the metal ring-shaped element 11 has the second ring face 21 forming a second indentation 22 for receiving the second annular flange 8. The second ring face 21 is concave towards the second annular flange 8 for receiving the second annular flange 8 so that the second ring face 21 forms the second indentation 22, in the form of a curvature, from the first ring end 12 to the second ring end 14. The second ring face 21 faces the second annular flange 8, and the curvature is configured to receive the second annular flange 8 when the downhole sealing assembly 1 is compressed between the first face 3 and the second face 4 of the completion component 50. The downhole sealing assembly 1 further comprises a third spring element 23 between the second ring face 21 and the second annular flange 8 so as to keep the second annular flange 8 in sealing abutment to the second face 4 of the completion component 50. During compression of the downhole sealing assembly 1, the second annular flange 8 is pressed into the second indentation 22, stretching the third spring element 23, whereupon the inherent spring force in the third spring element 23 will force the second annular flange 8 radially outwards towards the second face 4, thus providing an enhanced seal. The second annular flange 8 is shorter than the first annular flange 7 along the axial extension L and also shorter than the metal ring-shaped element 11 so that the second indentation 22 may more easily receive the second annular flange 8. By having both a first indentation 16 and a second indentation 22, the downhole sealing assembly 1 has a double sealing flexibility in that during compression both the first annular flange 7 and the second annular flange 8 can be received in an indentation, and due to the spring elements both annular flanges 7, 8 are pressed radially outwards after compression, providing an enhanced seal against both the first face 3 and the second face 4.

In FIG. 4, the second annular flange 8 comprises a projection 18 projecting away from the first annular flange 7. In a cross-sectional view, the first annular flange 7 has a U-shape forming a lip flange 19 for abutting the second face 4. The lip flange 19 has a tip 32 facing towards the base part 6. The downhole sealing assembly 1 further comprises a second spring element 20 arranged between the lip flange 19 and the first annular flange 7 so as to keep the first annular flange 7 in its intended extended position irrespectively of the compression of the lip flange 19 so that the lip flange 19 can function optimally as intended without being affected by any odd position of the first annular flange 7. The second spring element 20 overlaps the base part 6 and abuts the bend of the first annular flange 7, i.e. the "bottom" of the U-shape, in order to keep the first annular flange 7 fully extended. The second spring element 20 is ring-shaped. The first spring element 17 may in one aspect not shown have a slit in order to be more suited for mounting. The downhole sealing assembly 1 may be pressurised from both sides, and when the pressure is greater on the left side, the pressure forces the lip flange 19 radially outwards, thus sealing even better to the second face 4, and when the pressure is greater on the right side, the whole first annular flange 7, including the lip flange 19, is pressed radially outwards, thus enhancing the ability to seal to the second face 4. The pressure from the right also forces the second annular flange 8 towards the second face 4. As can be seen in FIG. 4, the projection 10 of the first annular flange 7 is part of the lip flange 19.

The second indentation 22 in FIG. 5 has a second indentation length $LI_2$ along the axial extension L. The second indentation length $LI_2$ is equal to the first indentation length W. The second annular flange 8 is shorter than the first annular flange 7 along the axial extension L. The downhole sealing assembly 1 further comprises a metal ring 24 having a flange 33 overlapping the base part 6 of the downhole sealing assembly 1 and a body part 34 abutting the base part 6, forming a back-up to the annular sealing element 5. The flange has a flange length LF along the axial extension L being the same or greater than the first thickness $t_1$ of the base part 6 so as to support the base part 6 in order to maintain the base of the annular sealing element 5.

In FIG. 6, the projection 18 of the second annular flange 8 has a second projection length $LP_2$ which is shorter than the second indentation length $LI_2$, shown in FIG. 5. The second annular flange 8 in FIG. 6 is shorter than the second annular flange 8 of FIG. 5 so that the second annular flange 8 having the projection 18 in FIG. 6 may be received in the second indentation 22 during compression of the downhole sealing assembly 1. The first indentation 16 is slightly greater than the second indentation 22 in that the second annular flange 8 comprises less material than the first annular flange 7 including the lip flange 19.

As shown in FIG. 7, the downhole sealing assembly 1 further comprises a fourth spring element 31 abutting the second spring element 20 so as to strengthen the second spring element 20 in order to keep the first annular flange 7 in its intended extended position irrespectively of the compression of the lip flange 19 so that the lip flange 19 can function optimally as intended without being affected by any odd position of the first annular flange 7.

By having such design of the downhole sealing assembly 1 as shown in FIGS. 1-12, the annular sealing element 5 can be made of Polytetrafluoroethylene (PTFE) so that the downhole sealing assembly 1 is capable of withstanding high temperatures above 225° C. while still functioning as intended. Known seals using elastomer or similar conventional sealing materials cannot withstand such high temperatures and still function properly as the material strength of such materials weakens significantly at such high temperatures. The spring elements 17, 20 are made of spring metal or spring steel, and the metal ring-shaped element 11 is made of metal proven for use in an oil or gas well. The materials of the downhole sealing assembly 1 are suited for geothermal wells as all materials in the downhole sealing assembly 1 can withstand the high temperatures in such geothermal wells without losing their sealing ability. The downhole sealing assembly 1 is thus able to function at temperatures above 220° C. and to withstand a pressure difference above 1400 PSI.

FIG. 7 shows a downhole sealing unit 30 comprising a first downhole sealing assembly 1, 1*a* and a second downhole sealing assembly 1, 1*b* corresponding to the downhole sealing assembly 1 previously described, wherein the base part 6 of the first downhole sealing assembly 1, 1*a* faces the base part 6 of the second downhole sealing assembly 1, 1*b* so that the first annular flange 7 of the first downhole sealing assembly 1 extends from the base part 6 and away from the first annular flange 7 of the second downhole sealing assembly 1, lb. Thus, the first downhole sealing assembly 1, 1*a* and the second downhole sealing assembly 1, 1*b* are arranged back-to-back in that the base parts 6 are closer to each other than the first annular flanges 7 are to each other. Because the downhole sealing assemblies 1, 1*a*, 1*b* are arranged back-to-back, the downhole sealing unit 30 can better withstand high pressure from one side, also when sliding past an opening in the first face 3 of the completion component 50 in that when one of the first downhole sealing assembly 1, 1*a* and the second downhole sealing assembly 1, 1*b* is passing the opening and thus not sealing optimally, the other downhole sealing assembly is able to provide sufficient sealing.

The downhole sealing unit 30 further comprises the metal ring 24 having a T-shape in cross-section and being arranged between the first downhole sealing assembly 1, 1*a* and the second downhole sealing assembly 1, 1*b*, abutting the base parts 6 of the first and second downhole sealing assemblies 1, 1*a*, 1*b*. The metal ring 24 comprises two flanges 33, 33A, 33B, each flange overlapping the base part 6 of the first downhole sealing assembly 1, 1*a* and the second downhole sealing assembly 1, 1*b*, respectively, and the body part 34 being arranged between the first downhole sealing assembly 1, 1*a* and the second downhole sealing assembly 1, lb. The metal ring 24 has the two flanges, i.e. a first projecting flange 33A overlapping the base part 6 of the first downhole sealing assembly 1, 1*a* along the axial extension L and a second projecting flange 33B overlapping the base part 6 of the second downhole sealing assembly 1, 1*b* along the axial extension L. The metal ring 24 thus forms a back-up to both the first downhole sealing assembly 1, 1*a* and the second downhole sealing assembly 1, lb. The flanges 33, 33A, 33B have a thickness that is substantially thicker than the lip flange 19. The metal ring 24 has at least one through-bore 25 extending radially in a direction perpendicular to the axial extension L for providing fluid communication. The through-bore 25 serves the purpose of equalising the pressure across the seal when one downhole sealing assembly 1, 1*a*, 1*b* is sliding past an opening in the second face 4 of the completion component 50; the pressure is quickly equalised through the through-bore 25 for optimising the sealing ability of the other downhole sealing assembly 1, 1*a*, 1*b*. This is due to the fact that when the first downhole sealing assembly 1, 1*a* is passing the opening and thus not sealing optimally, then the second downhole sealing assembly 1, 1*b* is able to provide sufficient sealing as the pressure is equalised to also affect the second annular flange 8 of the second downhole sealing assembly 1, lb. The metal ring 24 may have several through-bores 25 as shown in FIG. 8. Even though not shown, the annular sealing element 5 is made of PTFE and other parts of metal, where the spring elements 17, 20 are made of spring steel. A ring or tubular may be arranged in the through-bore 25.

The completion component 50 is shown in FIG. 9 forming part of a downhole system 100 and comprising a first component part 51 having the first face 3 and a second component part 52 having the second face 4 facing the first face 3. The first component part 51 and the second component part 52 are slidable in relation to each other. The completion component 50 further comprises the downhole sealing assembly 1, 1*a*, 1*b* as mentioned above for arrangement between the first face 3 and the second face 4. In FIG. 9, the completion component 50 is a sliding sleeve 50A or a telescopic joint 50B, and in FIGS. 10A-C the completion component 50 is a telescopic joint 50B. The sliding sleeve 50A of FIG. 9 has a sliding sleeve part 55 which is the second component part 52, and the sliding sleeve part 55 is slidable in relation to an opening 56 in a tubular section 58 which is the first component part 51, the tubular section 58 being mountable as part of a well tubular metal structure 90. The tubular section 58 comprises a groove 57 in which the sliding sleeve part 55 is slidably arranged. In another aspect, the sliding sleeve part 55 may be sliding along the inner face of the tubular section 58 without being arranged in the groove 57.

The telescopic joint 50B of FIGS. 10A-C is mountable as part of the well tubular metal structure 90, and the first component part 51 comprises a first part 61 overlapping a second part 62 of the second component part 52 so that when the temperature in the well changes, and the well tubular metal structure 90 either decreases or increases in length, this decrease or increase in length is accumulated by the first part 61 and the second part 62 as they are able to slide in relation to each other, thus accumulating the variations in length of the well tubular metal structure. FIG. 10A shows the telescopic joint 50B in its initial position where it is ready for an increase in the length of the well tubular metal structure 90 and thus strokes to its "stroked-out" position as shown in FIG. 10C, or for a decrease in the length of the well tubular metal structure 90 and thus strokes to its "stroked-in" position as shown in FIG. 10B. The telescopic joint 50B comprises in FIGS. 10A-C one downhole sealing assembly 1, but may in another embodiment comprise a plurality of downhole sealing assemblies 1, 1*a*, 1*b* arranged in between the first part 61 and the second part 62 for sealing against the first face 3 and the second face 4. The second component part 52 comprises an outer projection 63 projecting radially outwards from the second face 4 and having an outer diameter larger than an inner diameter of the first component part 51 so as to hinder the first component part 51 from sliding past the outer projection 63. The first component part 51 comprises an inner projection 64 projecting radially inwards from the first face 3, and the first part 61 has an inner diameter smaller than an outer diameter of the outer projection 63 of the second component part 52 so as to hinder the first component part 51 from sliding past the inner projection 64.

As shown in FIG. 9, the downhole system 100 comprises the completion component 50 mounted as part of the well tubular metal structure 90 and two annular barriers 80. Each annular barrier 80 comprises a tubular metal part 85 having an aperture 86 and an expandable metal sleeve 81 surrounding the tubular metal part 85, and each end 83, 84 of the expandable metal sleeve 81 is connected with the tubular metal part 85, forming an expandable space 82 when fluid enters the aperture for expanding the expandable metal sleeve 81 until the expandable metal sleeve 81 abuts a wall of the borehole 2.

FIG. 11 shows a cross-sectional view of another downhole sealing unit 30 comprising a first downhole sealing assembly 1, 1*a* and a second downhole sealing assembly 1, 1*b*, corresponding to the downhole sealing assembly 1 previously described, wherein the base part 6 of the first downhole sealing assembly 1, 1*a* faces the base part 6 of the second downhole sealing assembly 1, 1*b*, so that the first annular flange 7 of the first downhole sealing assembly 1 extends from the base part 6 and away from the first annular flange 7 of the second downhole sealing assembly 1, lb. Thus, the first downhole sealing assembly 1, 1*a* and the second downhole sealing assembly 1, 1*b* are arranged back-to-back in that the base parts 6 are closer to each other than the first annular flanges 7 are to each other. The downhole sealing unit 30 further comprises the metal ring-shaped element 11 which is formed of two abutting ring-shaped elements 11*a*, 11*b* being a first metal ring-shaped element 11*a* and a second metal ring-shaped element 11*b*. Furthermore, the first ring face 15 forming the first indentation 16 is formed partly of the first metal ring-shaped element 11*a* and partly of the second metal ring-shaped element 11*b* for forming the cavity 9.

Furthermore, the metal ring 24 is formed of two abutting rings 24*a*, 24*b* being a first metal ring 24*a* and a second metal ring 24*b*, so that the abutting first metal ring 24*a* and second metal ring 24*b* have a T-shaped cross-section which is formed of a stem part 53 and projecting flanges 33, 54*a*, 54*b*, where each of the projecting flanges 33, 54*a*, 54*b* overlaps the first downhole sealing assembly 1, 1*a* and the second downhole sealing assembly 1, 1*b*, respectively. Thus, each abutting ring 24*a*, 24*b* has an L-shaped cross-section which, when the ring is abutting, forms a T-shaped cross-section. The downhole sealing unit 30 further comprises at least one through-bore 25 which intersects both of the two abutting rings 24*a*, 24*b*, so that part of the through-bore 25 forms a groove 25*a* in one of the two abutting rings, and the other part of the through-bore 25 forms a groove 25*b* in the other of the two abutting rings, which grooves together form the through-bore.

The downhole sealing unit 30 further comprises a first element 41 having a first inclined face 42 abutting a second inclined face 43 of the metal ring 24. By having a first element 41 with the inclined face 42 configured to slide in relation to the second inclined face 43, the first element 41 can slide and move towards the second face 4 when the pressure acts on the downhole sealing assembly 1, squeezing the downhole sealing assembly 1 so that the base part 6 presses onto the first element 41. By being able to move towards the second face 4, the first element 41 keeps forming a sufficient back-up to the downhole sealing assembly 1 and provides a pre-tensioning force on the downhole sealing assembly 1 so that when the pressure releases, the first element 41 is able to press the downhole sealing assembly 1 to return to its less pressurised condition. The first element 41 having the first inclined face 42 abuts the second inclined face 43 on a first side 44 of the metal ring 24, and the downhole sealing unit 30 further comprises a second element 45 having a first inclined face 46 abutting a second inclined face 47 on a second side 48 of the metal ring 24. The first element 41 and the second element 45 may be of PEEK (Polyether ether ketone) or PAEK (Polyaryletherketone) or similar material, or metal.

FIG. 12 shows a cross-sectional view of another downhole sealing unit 30 comprising a first downhole sealing assembly 1, 1*a* and a second downhole sealing assembly 1, 1*b*, corresponding to the downhole sealing assembly 1 previously described. The first downhole sealing assembly 1, 1*a* abuts the second downhole sealing assembly 1, 1*b*, so that the first annular flange 7 of the first downhole sealing assembly 1*a* extends towards and faces the first annular flange 7 of the second downhole sealing assembly 1*b*. The first downhole sealing assembly 1, 1*a* and the second downhole sealing assembly 1*b* are thus arranged to abut and face each other with no separate element arranged therebetween. Thus, the metal ring-shaped element 11 of the first downhole sealing assembly 1, 1*a* abuts the metal ring-shaped element 11 of the first downhole sealing assembly 1*a*.

The downhole sealing unit 30 further comprises at least one through-bore 25 intersecting both metal ring-shaped elements 11, so that part of the through-bore 25 forms a groove 25*a* in one of the metal ring-shaped elements 11, and the other part of the through-bore 25 forms a groove 25*b* in the other of the metal ring-shaped elements 11, which grooves together form the through-bore.

The downhole sealing unit 30 further comprises a first metal ring 24*a* and a second metal ring 24*b*. The first metal ring 24*a* is arranged to abut the base part 6 of the first downhole sealing assembly 1*a*, and the second metal ring 24*b* is arranged to abut the base part 6 of the second downhole sealing assembly 1*b*. The first metal ring 24*a* has an L-shape in cross-section and is formed of a stem part 53 and one projecting flange 54*a*, where the one projecting flange 54*a* overlaps the base part 6 of the first downhole sealing assembly 1*a*. The second metal ring 24*b* has an L-shaped cross-section which is formed of a stem part 53 and one projecting flange 54*b*, where the one projecting flange 54*b* overlaps the base part 6 of the second downhole sealing assembly 1*b*.

The downhole sealing unit 30 of FIG. 12 further comprises a first element 41 having a first inclined face 42 abutting a second inclined face 43 of the first metal ring 24*a* and a second element 45 having a first inclined face 46 abutting a second inclined face 47 of the second metal ring 24*b*.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "annular barrier" is meant an annular barrier comprising a tubular metal part mounted as part of the well tubular metal structure and an expandable metal sleeve surrounding and connected to the tubular metal part defining an annular barrier space.

By "casing" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. A downhole sealing assembly for providing a seal in a borehole between a first face and a second face of a completion component having an axial extension along the borehole, comprising:

an annular sealing element for arrangement on the second face and having a base part, a first annular flange and a second annular flange extending from the base part along the axial extension, forming a cavity between the first and second annular flanges, the first annular flange being arranged closest to the first face and having a projection for abutment to the second face, and a metal ring-shaped element arranged in the cavity and having a first ring end close to the base part and a second ring end opposite the first ring end, the metal ring-shaped element having a first ring face forming a first indentation for receiving the first annular flange, wherein the downhole sealing assembly further comprises a first spring element arranged in the cavity between the first annular flange and the metal ring-shaped element in order to press the first annular flange to abut against the second face.

2. The downhole sealing assembly according to claim 1, wherein the first spring element is plate- and tubular-shaped.

3. The downhole sealing assembly according to claim 1, wherein the second annular flange comprises a projection projecting away from the first annular flange.

4. The downhole sealing assembly according to claim 1, wherein the first annular flange in cross-section has a U-shape forming a lip flange for abutting the second face.

5. The downhole sealing assembly according to claim 4, further comprising a second spring element arranged between the lip flange and the first annular flange.

6. The downhole sealing assembly according to claim 5, wherein the metal ring-shaped element has a second ring face forming a second indentation for receiving the second annular flange.

7. The downhole sealing assembly according to claim 6, further comprising a third spring element between the second ring face and the second annular flange.

8. A downhole sealing unit comprising a first downhole sealing assembly and a second downhole sealing assembly according to claim 1, wherein the base part of the first downhole sealing assembly is arranged closer to the base part of the second downhole sealing assembly than the annular flanges so that the first annular flange of the first downhole sealing assembly extends from the base part of the first downhole sealing assembly away from the first annular flange of the second downhole sealing assembly.

9. The downhole sealing unit according to claim 8, further comprising a metal ring having a T-shape in cross-section, the metal ring being arranged between the first downhole sealing assembly and the second downhole sealing assembly, abutting the base parts of the first and second downhole sealing assemblies.

10. The downhole sealing unit according to claim 9, wherein the metal ring has at least one through-bore extending radially in a direction perpendicular to the axial extension for providing fluid communication.

11. The downhole sealing unit according to claim 9, wherein the metal ring has a first projecting flange overlapping the base part of the first downhole sealing assembly along the axial extension and a second projecting flange overlapping the base part of the second downhole sealing assembly along the axial extension.

12. The downhole sealing assembly according to claim 1, wherein the base part has a first thickness along the axial extension, the first annular flange has a second thickness, and the second annular flange has a third thickness perpendicular to the axial extension, the first thickness being greater than the second thickness and/or the third thickness.

13. A completion component comprising a first component part having a first face and a second component part having a second face facing the first face, the first component part and the second component part being slidable in relation to each other, and the completion component further comprising the downhole sealing assembly according to claim 1 for arrangement between the first face and the second face.

14. The completion component according to claim 13, wherein the completion component is a sliding sleeve or a telescopic joint.

15. A downhole system comprising the completion component according to claim 13 mounted as part of a well tubular metal structure and an annular barrier.

* * * * *